US006729628B2

(12) United States Patent
Bellehumeur et al.

(10) Patent No.: US 6,729,628 B2
(45) Date of Patent: May 4, 2004

(54) BRAKE FOR INLINE SKATES

(76) Inventors: Alex R. Bellehumeur, 6242 Napoli Ct., Long Beach, CA (US) 90803; Ronald H. Powers, 2175 Pacific Ave. #H4, Costa Mesa, CA (US) 92627

( * ) Notice: Subject to any disclaimer, the term of this patent is extended or adjusted under 35 U.S.C. 154(b) by 12 days.

(21) Appl. No.: 10/092,828

(22) Filed: Mar. 6, 2002

(65) Prior Publication Data

US 2003/0168822 A1 Sep. 11, 2003

(51) Int. Cl.[7] ..... A63C 17/14

(52) U.S. Cl. ..... 280/11.215; 280/11.204; 280/11.19; 188/17; 188/5

(58) Field of Search ..... 280/11.215, 11.217, 280/11.221, 11.204, 11.205, 11.211, 11.212, 11.214; 188/17, 5

(56) References Cited

U.S. PATENT DOCUMENTS 3,900,203 A * 8/1975 Kukulowicz ..... 280/11.205
4,799,701 A * 1/1989 Lindau et al. ..... 280/87.041
5,351,974 A * 10/1994 Cech ..... 280/11.212
5,464,235 A * 11/1995 Goldman et al. ..... 280/11.212
5,639,104 A * 6/1997 Haldemann ..... 280/11.207
5,752,707 A * 5/1998 Cottle et al. ..... 280/11.214
5,997,015 A * 12/1999 Bellehumeur ..... 280/11.215
6,039,330 A * 3/2000 Hoskin ..... 280/11.215
6,102,168 A * 8/2000 Brandriff et al. ..... 188/71.5
6,131,922 A * 10/2000 Klukos ..... 280/11.206
6,446,982 B1 * 9/2002 Gaster et al. ..... 280/11.205
2003/0107194 A1 * 6/2003 Bellehumeur et al. . 280/11.215

* cited by examiner

*Primary Examiner*—Brian L. Johnson
*Assistant Examiner*—Kelly E Campbell
(74) *Attorney, Agent, or Firm*—Edgar W. Averill, Jr.

(57) ABSTRACT

A brake assembly for applying a braking force to one or more wheels of a wheel supported device, such as an inline skate. The brake assembly has a rotating brake member held by one or more wheels, which is preferably a disk shaped brake, partially embedded on one or both sides of a wheel. A fixed brake member is held so that it does not turn with respect to the wheel frame. The fixed brake member has a friction surface positioned adjacent the braking surface of the rotating member. The fixed brake member can be bent so that its friction surface contacts the rotating brake member to apply a braking force to the rotation of the wheel. Preferably, the fixed brake member is bent by a cam surface and the cam surface is contacted by a movable brake arm held by the frame.

14 Claims, 5 Drawing Sheets

FIG. 7
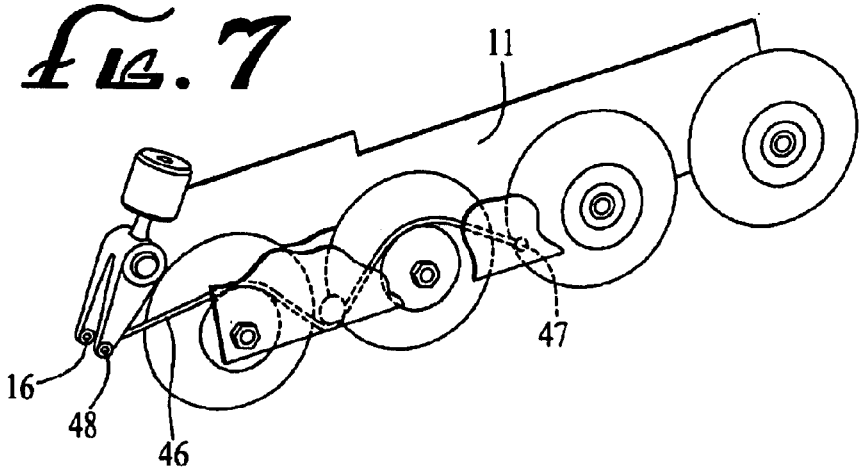
FIG. 8
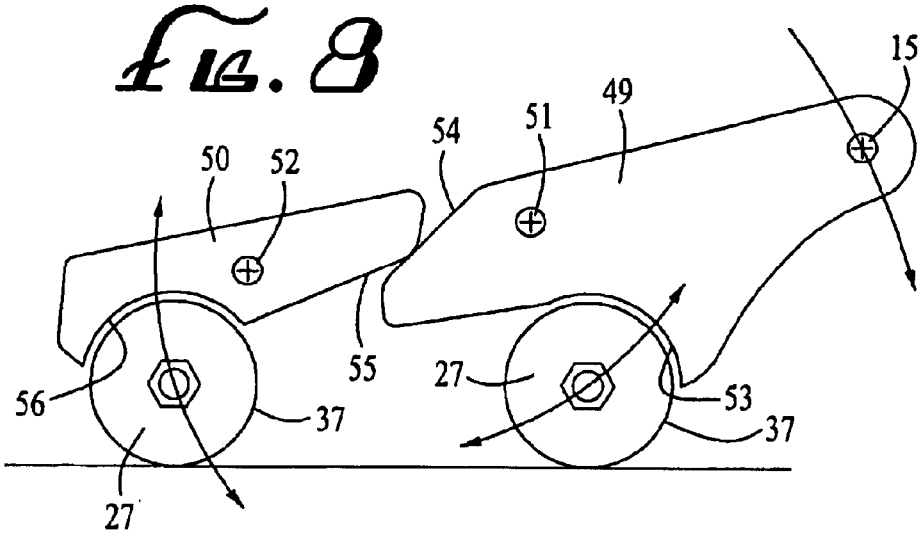
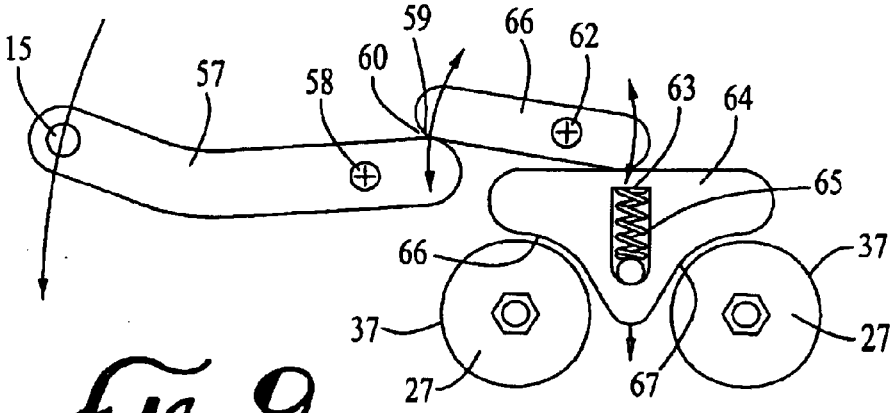
FIG. 9

BRAKE FOR INLINE SKATES

BACKGROUND OF THE INVENTION

The field of the invention is braking assemblies for wheel supported devices, such as an inline skate. Although there are many patents on brakes for inline skates which operate to slow the rotation of one or more wheels of the inline skate, the most popular way of stopping an inline skate comprises a brake pad positioned at the back of the inline skate which is dragged against the ground by tipping the skate back so that the pad contacts the surface on which the skater is skating.

One skate brake design is shown in U.S. Pat. No. 5,997,015 assigned to one of the inventors of the present patent and the disclosure of this patent is hereby incorporated by reference herein. This brake is activated by the rearward pivoting of a collar or horseshoe shaped member 15 which moves a pivoted brake member 22 into contact with two rotating brake disks supported by two of the wheels of the inline skate.

Although the design of U.S. Pat. No. 5,997,015 is effective, it is limited in brake pad surface contact area and in heat dissipation.

BRIEF SUMMARY OF THE INVENTION

It is an object of the present invention to provide a brake assembly for inline skates and other wheel supported devices which has a relatively large braking surface and the ability to dissipate the heat generated by the braking action.

The present invention is for a brake assembly for applying a braking force to one or more wheels of a wheel supported device. The wheel supported device has a wheel frame which in turn, supports a plurality of wheels on a plurality of axles held by the wheel frame. The assembly has a rotating brake member held by at least one of the plurality of wheels on at least one side thereof. The rotating brake member has an outwardly facing braking surface which rotates with the wheel. A fixed brake member is held so that it does not turn with the wheels. The fixed brake member has an inwardly facing friction surface positioned adjacent at least a portion of the outwardly facing braking surface of the rotating brake member. Means are provided for controllably bending the fixed brake member toward the rotating brake member so that the outwardly facing braking surface of the rotating brake member contacts the inwardly facing friction surface of the fixed brake member, thereby applying a braking force on the wheel. Preferably, the brake member is moved by contact with the cam surface on the outer periphery of the fixed brake member. This cam surface is contacted by a brake activation arm pivotally or otherwise held by the frame between an inner surface of the frame and the fixed brake member. The cam surfaces can be a 45° chamfer and the brake activating arm is positioned between the fixed brake member and the inner surface of the frame. The fixed brake member is preferably disk shaped and held by the frame by a non-circular protrusion, such as a hexagonal protrusion, which fits into a shaped opening in the frame. When the axle is tightened in the frame, the fixed brake member is tightened between the frame and the center area of the wheel bearing assembly, so that the center part of the fixed brake member does not move inwardly or outwardly, but instead, the braking action is caused by a bending of the fixed brake member. The fixed brake member may have a plurality of slits to divide the fixed brake member into a number of segments. The brake actuating arm can move a single segment. When the single segment becomes worn, the fixed brake member can be loosened and turned so that an adjacent segment contacts the movable brake member supported by the wheel. There can be brake pads on both sides of one, two or all wheels, although the assembly is workable with as little as one side of one wheel being provided with a brake assembly.

BRIEF DESCRIPTION OF THE DRAWINGS

FIG. 7 is a perspective view showing an alternate embodiment of the brake actuating member of the brake assembly of the present invention.

FIG. 8 is a side view of an alternate embodiment utilizing a pair of pivoted brake actuating arms.

FIG. 9 is a side view of an alternate embodiment of actuating arms useful with the skate brake of the present invention.

DESCRIPTION OF THE PREFERRED EMBODIMENTS

Figure 1:
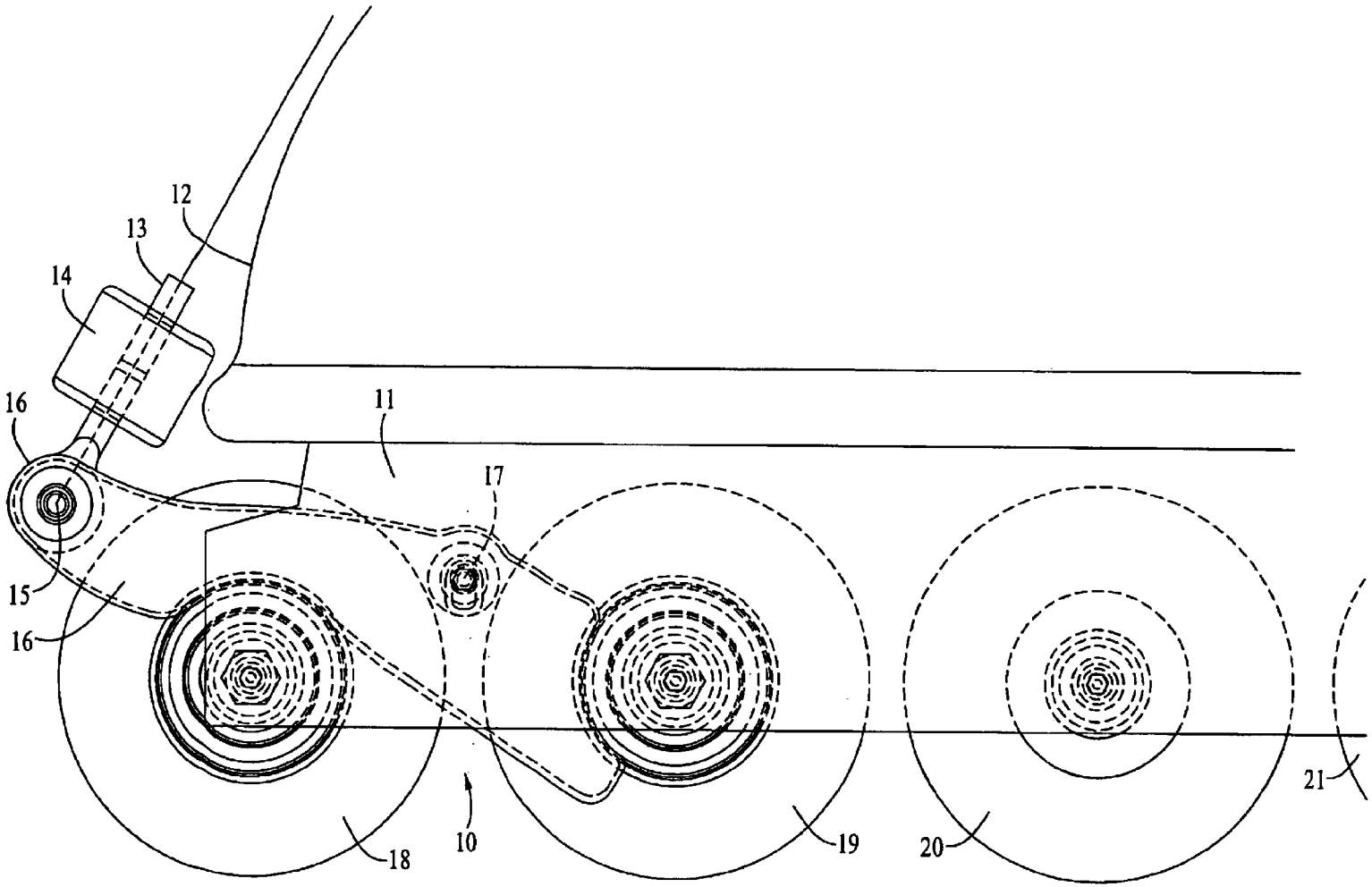
FIG. 1 is a side view of a first embodiment of the brake assembly of the present invention.

The brake assembly of the present invention is shown in side view in FIG. 1 and indicated generally by reference character 10. The brake assembly is supported on a frame 11 which is affixed to the bottom of boot 12. A brake control arm 13 may be moved in various ways and one such way is shown in U.S. Pat. No. 5,997,015, which utilizes a pivoted U-shaped collar surrounding the ankle portion of the boot. An adjustment wheel 14 permits the length adjustment of arm 13. Arm 13 is pivotally connected at pin 15 to the rear 16 of movable brake actuating arm 16. Movable activating arm 16 is pivotally held about pivot pin 17 to frame 11.

Frame 11 supports a plurality of wheels 18, 19, 20, and 21. Wheels 18 and 19 are equipped with the braking assembly of the present invention.

Figure 2:
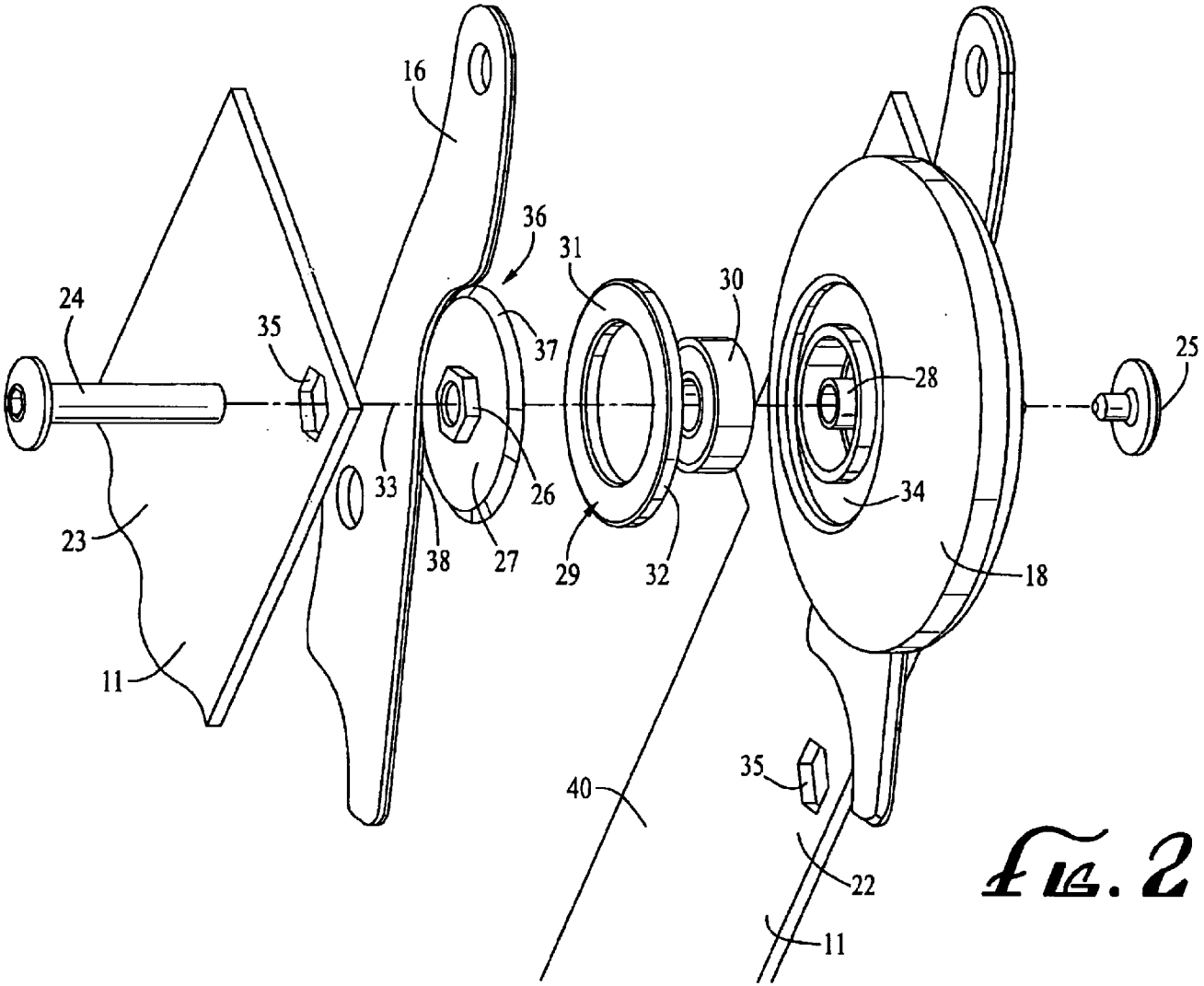
FIG. 2 is an exploded perspective view thereof.

One embodiment of the braking assembly of the present invention is shown in an exploded perspective view in FIG. 2. In FIG. 2 it can be seen that wheel 11 has a right side 22 and a left side 23. An axle 24 extends through the right and left sides 22 and 23, and is tightened in a conventional manner by tightening axle screw 25 into a threaded opening in axle 24. As shown best in FIG. 3, the tightening of axle screw 25 tightens the axle against a collar 26 in a fixed brake member 27 which, in turn, contacts axle support sleeve 28. Axle support sleeve 28 abuts collar 26 of another fixed brake member 27 on the opposite side of wheel 18. Thus, it can be seen that fixed brake member cannot move either to the right or left as viewed in FIG. 3.

The brake assembly includes a rotating brake member 29 embedded in one or both sides of the hub of wheel 18. The rotating brake member could, alternatively, be affixed to the outer surface without being embedded and be removable and replaceable, but to conserve space, the embedding of the rotating brake member is preferred. Fixed brake member 27 also functions as a contaminent guard to help prevent debris from entering the bearing. A separate contaminent shield can also be used.

Wheel 18 is supported in a conventional manner by a pair of wheel bearings, which in turn are supported by the hub of the wheel in a conventional manner. Rotating brake member 29 is shown in perspective view in FIG. 2 and can be seen to have an axially outwardly facing braking surface 31. The term "outwardly" can be somewhat ambiguous and, thus, the term "axially outwardly" is used herein to indicate that it is facing outwardly in a manner parallel to the axis 33 of wheel 18. Surface 32 of rotating brake member 29 would be referred to herein as radially outwardly facing.

The rotating brake member 29 is preferably fabricated from a "brake and material" which is typically a composite material known to those skilled in the art. "Brake pad material" can also be fabricated from a polymer or a composite polymer. It is advantageous that the rotating brake member be a poor conductor of heat and that the fixed brake member 27 be a relatively good conductor of heat. In this way, heat generated in the surface between the fixed and rotating brake members tends to be drawn into the fixed brake member wherein it can be readily conducted into the large frame which is evident from viewing FIG. 3. The frame is typically fabricated from aluminum, which is an excellent conductor of heat and will assist in dissipating the heat generated by braking action.

As best seen in FIG. 2, fixed brake member 27 is held in a non-rotating manner by wheel frame 11 by the use of a non-circular protrusion 26, which fits in a non-circular opening 35. As shown in FIG. 2, protrusion 26 is hexagonal and fits into hexagonal opening 35 so that fixed brake member 27 cannot turn with respect to wheel frame 11. The rotating brake member 29 is secured in a cavity 34 formed in wheel 18 so that it rotates with wheel 18.

In order to initiate a braking action, the fixed brake member 27 is moved at least in part so that a friction surface 36 contacts the axially outwardly facing braking surface 31. One way of moving a portion of fixed brake member 27 comprises movable brake actuating arm 16. The radially outwardly facing surface 37 is chamfered as shown in FIGS. 2 an 3 and the movable brake activating arm 16 is also chamfered, as shown best in FIG. 3 at 38, as can be readily understood by viewing FIG. 3. As movable activating arm 16 is lowered as viewed in FIG. 3, its chamfer 38 contacts the chamfered surface 37 of fixed brake member 27 bending toward rotating brake member 29. The result is a contact between the friction surface 36 and the axially outwardly facing braking surface 31.

The fixed brake member 27 may be fabricated from spring steel. Alternatively, it may be made from a composite material, such as glass filled nylon. It is important that the fixed brake member 27 have a certain amount of elasticity so that when the cam surfaces are no longer in contact, it springs back to its original position where it does not interfere with the rotating of wheel 18.

Figure 3:
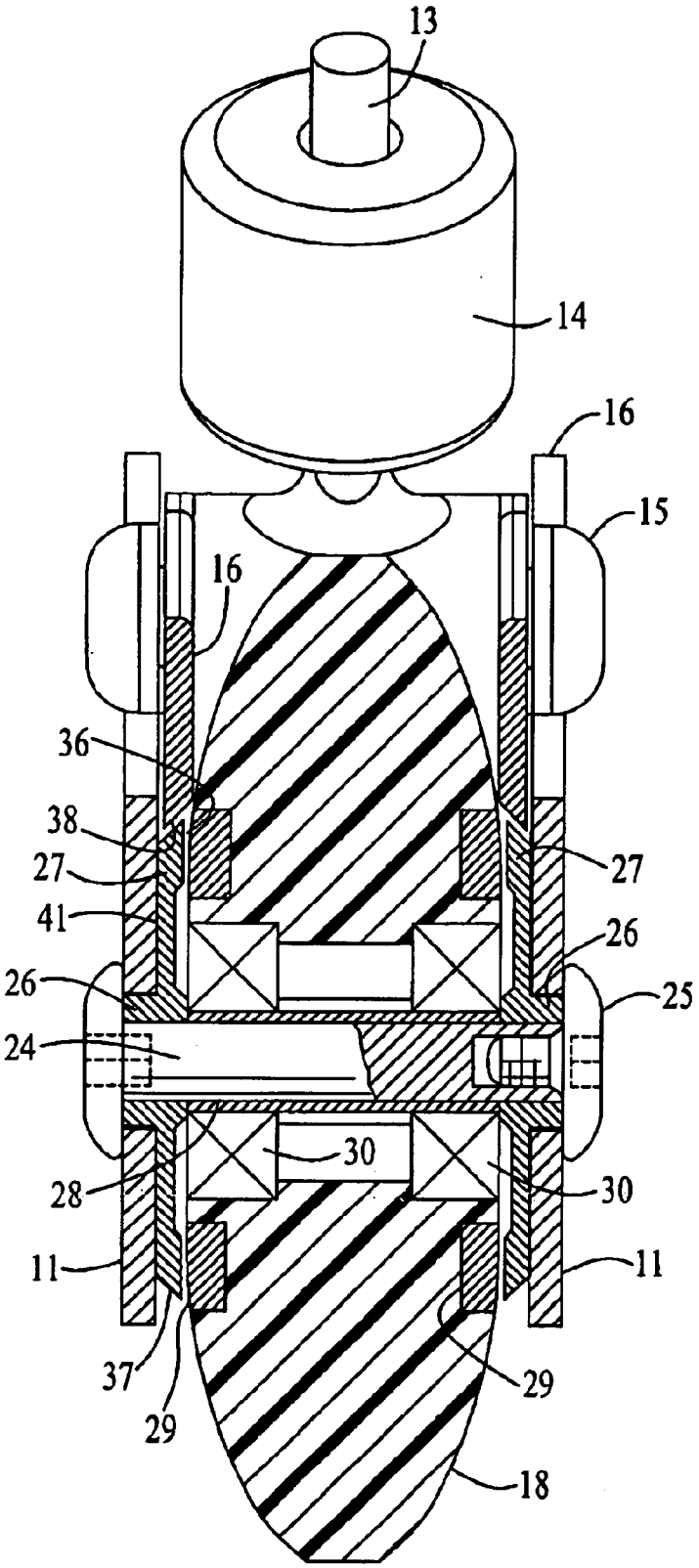
FIG. 3 is a cross-sectional view thereof.

As also evident from FIG. 3, the movable brake actuating arm 16 has an outer surface 39 which can contact the inner surface 40 of frame 11. In this way, arm 16 is prevented from outward movement as the cam surfaces are contacting one another and the necessity of lateral support at the pivotal point is eliminated. Also, a certain amount of heat would be conducted through arm 16, some of which would also be conducted into frame 11.

The larger portion of the heat generated by braking would be conducted from the outer surface 41 of fixed brake member 27 to the inner surface 40 of frame 11, and thus, into frame 11. As stated above, frame 11 provides a relatively large heat sink for dissipation of braking heat.

Returning now to FIG. 4, the bending of fixed brake member 27' can be facilitated by the addition of slits 42 and six such slits are shown in FIG. 4. In this way, only a portion of the fixed brake member 27 need be bent, although a non-slitted fixed brake member can still be used.

Another important feature of the present invention is the ability to compensate for wear of friction surface 36 of fixed brake member 27. This is accomplished by removing axle 24 and wheel 18 with its associated bearings. Next, the fixed axle members are unplugged so that the protrusion 26 is removed from the non-circular opening 35 after which the fixed brake member may be turned, for instance 60°, to expose a different part of its friction surface 36 to contact with rotating brake member 29.

Figure 5:
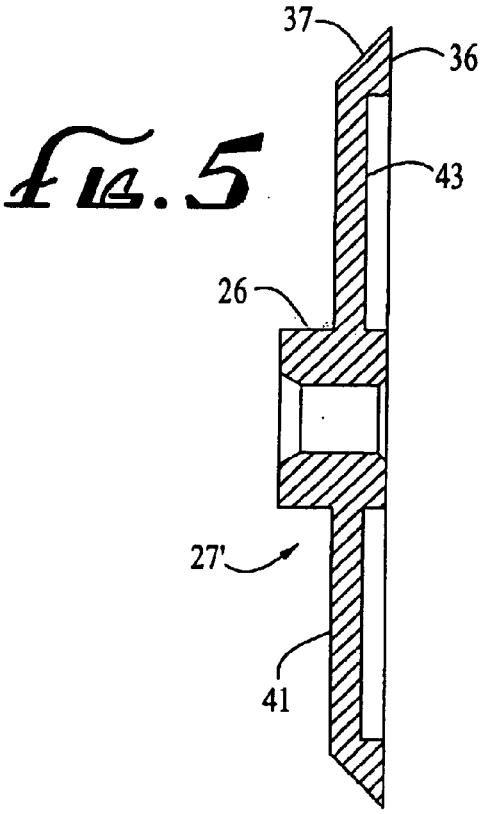
FIG. 5 is a cross-sectional view taken along line 5—5 of FIG. 4.

A cross-sectional view of fixed brake member 27' is shown in FIG. 5. There it can be seen that a recess 43 is formed within friction surface 36 to further facilitate the bending of fixed brake member 27.

Figure 4:
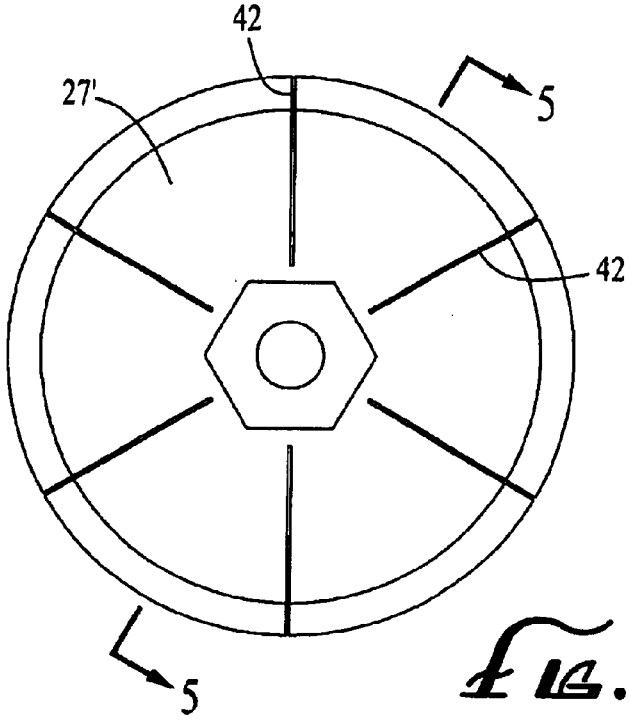
FIG. 4 is a side view of a fixed brake member of the present invention, including slits.
Figure 6:
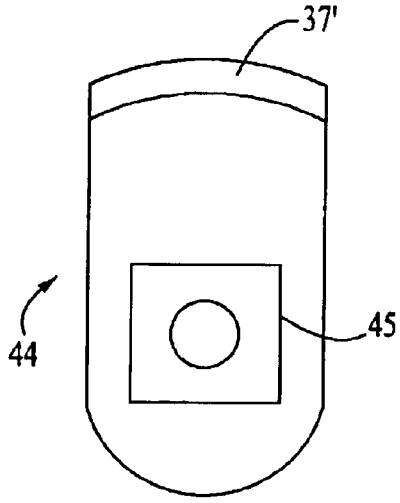
FIG. 6 is a side view of an alternate embodiment of a fixed brake member of the present invention.

While the fixed brake member 27 is shown as being disk shaped in FIGS. 2 and 4, it need not be a complete disk. A single segment shaped brake member is shown in FIG. 6 and it has a cam surface 37'. Its protrusion, rather than being hexagonal, is shown as a square protrusion 45. Of course, the shape of the protrusion is not critical as long as the shape prevents the turning of member 27 with respect to frame 11.

The means for controllably bending the fixed brake member is not critical and numerous constructions are possible. For instance, in FIG. 7, a flexible cable 46 is fixed at one end 47 to frame 11, and at the other end 48 to pin 16. The outer surface of the cable wedges against the cam surface 37 of the fixed brake member 27 and forces it against the rotating brake member 29.

Also, in the event pivoted arms are used, they can be fabricated in numerous ways. As shown in FIG. 8, two pivoted arms 49 and 50 are pivotally held by frame 11 (not shown in FIG. 8) at pivot points 51 and 52, respectively. As a downward force is exerted at pivot point 15, cam surface 53 contacts cam surface 37. At the same time, cam surface 54 on arm 49 pushes against cam surface 55 on arm 50. This causes cam surface 56 to press against cam surface 37 of fixed brake member stater 27.

A still further brake configuration is shown in FIG. 9 where downward force applied at pin 15 pivots arm 57 around pivot point 58. This causes contact surface 59 of arm 57 to abut contact surface 60 of arm 61. This causes arm 61 to pivot about pivot point 62. This forces contact surface 63 of arm 61 to press down against movable brake activating arm 64. Compression spring 65 urges arm 64 upwardly and out of contact with fixed brake members 27. However, when pin 15 moves downwardly, this causes activating arm 64 to move downwardly so that its cam surfaces 66 and 67 abut cam surfaces 37 of fixed brake members 27, causing a braking action on two adjacent wheels.

It has been found that a 45° cam surface angle works satisfactorily, although larger or smaller angles may be used. While flat surfaces are shown, the cam surfaces can, of course, have a curved cross-sectional shape. While the skate brake of the present invention has been discussed in conjunction with inline skates, it can, of course, be used in other wheel supported devices, such as skateboards, scooters, and the like. It has the advantage of a relatively small number of parts and requires a minimal change in the existing structure of devices to which it can be added.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A brake assembly for applying a braking force to one or more wheels of a wheel supported device supporting a wheel frame which, in turn, supports a plurality of wheels on a plurality of axles held by said wheel frame each of said plurality of wheels having two sides, said brake assembly comprising:

a rotating brake member held by at least one of said plurality of wheels on at least one side thereof, said rotating brake member having an outwardly facing braking surface which rotates with said wheel;

a fixed brake member held so that it does not turn with said at least one of said plurality of wheels, said fixed brake member having an inwardly facing friction surface positioned adjacent at least a portion of said outwardly facing braking surface of said rotating brake member;

means for controllably bending said fixed brake member toward said rotating brake member so that the outwardly facing braking surface of the rotating brake member contacts the inwardly facing friction surface of said fixed brake member thereby applying a braking force on said at least one of said plurality of wheels;

wherein said fixed brake member has an outer peripheral edge and a central axis and said means for controllably bending said fixed brake member comprises exerting an axially inward directed force on said fixed brake member at a position nearer said outer peripheral edge than said central axis of said fixed brake member; and wherein said fixed brake member has a generally outwardly directed cam surface on its outer peripheral edge and a movable brake activating member has a mating generally inwardly directed cam surface thereon and wherein said means for controllably bending said fixed brake member comprises contacting said generally outwardly directed cam surface with said mating generally inwardly directed cam surface and moving said mating generally inwardly directed cam surface toward an inner area of said fixed brake member so that said generally inwardly directed cam surface moves said generally outwardly directed cam surface and a portion of said fixed brake member into contact with said rotating brake member.

2. The brake assembly of claim 1 wherein said movable brake activating member is pivotally held by said wheel frame.

3. The brake assembly of claim 2 wherein said movable brake activating member is restrained from movement away from said rotating brake member by contact with an inner surface of said wheel frame.

4. The brake assembly of claim 1 wherein said outwardly and inwardly directed cam surfaces comprise a 45 degree chamfer with respect to an axis of rotation of said at least one of said plurality of wheels.

5. The brake assembly of claim 1 wherein said fixed brake member is held against rotation by said wheel frame by a non-circular protrusion which fits into a mating non-circular opening in said wheel frame surrounding said axle.

6. The brake assembly of claim 5 wherein said non-circular protrusion and said mating non-circular opening are polygonal in outer peripheral shape.

7. The brake assembly of claim 1 wherein said fixed brake member has a generally outwardly directed cam surface on its outer peripheral edge and a movable brake activating member comprises a flexible cable held by said wheel frame and said outwardly directed cam surface is located adjacent an inner surface of said wheel frame so that the tightening of said flexible cable presses the cable against the outwardly directed cam surface and the inner surface of said wheel frame.

8. A brake assembly for applying a braking force to one or more wheels of a wheel supported device supporting a wheel frame which, in turn, supports a plurality of wheels on a plurality of axles held by said wheel frame each of said plurality of wheels having two sides, said brake assembly comprising:

a rotating brake member held by at least one of said plurality of wheels on at least one side thereof, said rotating brake member having an outwardly facing braking surface which rotates with said wheel;

a fixed brake member held so that it does not turn with said at least one of said plurality of wheels, said fixed brake member having an inwardly facing friction surface positioned adjacent at least a portion of said outwardly facing braking surface of said rotating brake member;

means for controllably bending said fixed brake member toward said rotating brake member so that the outwardly facing braking surface of the rotating brake member contacts the inwardly facing friction surface of said fixed brake member thereby applying a braking force on said at least one of said plurality of wheels;

wherein said fixed brake member has a disk shaped body and an outer peripheral edge which is circular and extends 360 degrees around said disk shaped body; and wherein said disk shaped body has a plurality of slits formed in said body extending inwardly from said outer peripheral edge to permit the bending of a portion of said disk shaped body while not bending another portion of said disk shaped body.

9. The brake assembly of claim 7 wherein said slits are radially oriented.

10. The brake assembly of claim 9 wherein there are six slits.

11. A brake assembly for applying a braking force to one or more wheels of a wheel supported device supporting a wheel frame which, in turn, supports a plurality of wheels on a plurality of axles held by said wheel frame each of said plurality of wheels having two sides, said brake assembly comprising:

a rotating brake member held by at least one of said plurality of wheels on at least one side thereof, said rotating brake member having an outwardly facing braking surface which rotates with said wheel;

a fixed brake member held so that it does not turn with said at least one of said plurality of wheels, said fixed brake member having an inwardly facing friction surface positioned adjacent at least a portion of said outwardly facing braking surface of said rotating brake member;

means for controllably bending said fixed brake member toward said rotating brake member so that the outwardly facing braking surface of the rotating brake member contacts the inwardly facing friction surface of said fixed brake member thereby applying a braking force on said at least one of said plurality of wheels; and wherein said frame has a right and a left frame member on each side of each wheel and said axle extends through said right and left frame member and has an axle tightening member which rests against an outer surface of said right and left frame members and said fixed brake member is has a central opening surrounding an axle and said fixed brake member has a central protrusion which is secured against movement by the tightening of said axle tightening member.

12. The brake assembly of claim 1 wherein said rotating brake member, said fixed brake member and said means for controllably bending said fixed brake member are positioned on both sides of said at least one of said plurality of wheels.

13. The brake assembly of claim 12 wherein said rotating brake member, said fixed brake member and said means for controllably bending said fixed brake member are positioned on both sides of two of said plurality of wheels.

14. A brake assembly for stopping an in line skate which has a boot portion supporting a wheel frame which supports a plurality of axles, each of which support a rotating wheel and each rotating wheel has a first side and a second side and at least one of said rotating wheels has a rotating brake pad ring at least partially embedded in a side of said wheel and having a braking surface and said wheel frame supporting a fixed, bendable fixed brake member having an inner friction surface positioned adjacent said rotating brake pad ring;

means for controllably bending said bendable fixed brake member so that the inner friction surface controllably contacts said braking surface; and wherein said means for controllably bending said bendable fixed brake member comprises a cam surface on an outer peripheral surface of said bendable fixed brake member and a movable brake activating arm pivotally supported by said wheel frame adjacent an inner surface thereof and said movable brake activating arm having a mating cam surface positioned so that the moving of said brake activating arm forces the two cam surfaces against one another and forces said brake activating arm against the inner surface of said wheel frame and against the cam surface of the fixed brake member thereby bending a portion of said bendable fixed brake member so that its inner friction surface presses against the rotating brake pad ring.

* * * * *